US006339906B1

(12) United States Patent
Ginet et al.

(10) Patent No.: US 6,339,906 B1
(45) Date of Patent: Jan. 22, 2002

(54) FRONTAGE ELEMENT WITH DECORATIVE FACING

(75) Inventors: Marc Ginet, Saint-Maur; Michel Le Feron De Longcamp, Mathieu, both of (FR)

(73) Assignee: Elf Atochem S.A., Puteaux (FR)

( * ) Notice: Subject to any disclaimer, the term of this patent is extended or adjusted under 35 U.S.C. 154(b) by 0 days.

(21) Appl. No.: 09/269,747

(22) PCT Filed: Oct. 6, 1997

(86) PCT No.: PCT/FR97/01771

§ 371 Date: Jun. 10, 1999

§ 102(e) Date: Jun. 10, 1999

(87) PCT Pub. No.: WO98/15699

PCT Pub. Date: Apr. 16, 1998

(30) Foreign Application Priority Data

Oct. 8, 1996 (FR) ..... 96 12260

(51) Int. Cl.[7] ..... E04B 2/88

(52) U.S. Cl. ..... 52/235; 52/236.9; 52/509; 52/733.4

(58) Field of Search ..... 52/235, 236.3, 52/236.7, 236.9, 396.1, 546, 464, 478, 483.1, 204.591, 733.4, 730.3, 509

(56) References Cited

U.S. PATENT DOCUMENTS

| | | | | | |
|---|---|---|---|---|---|
| 3,940,897 | A | * | 3/1976 | Stoakes | 52/395 |
| 3,994,107 | A | * | 11/1976 | Aughuet | 52/235 |
| 4,924,647 | A | * | 5/1990 | Drucker | 52/235 |
| 4,979,344 | A | * | 12/1990 | Kusunoki | 52/235 |
| 5,058,344 | A | * | 10/1991 | Biebuyck | 52/235 |
| 5,212,914 | A | * | 5/1993 | Martin et al. | 52/235 |
| 5,263,292 | A | * | 11/1993 | Holland et al. | 52/235 |
| 5,544,461 | A | * | 8/1996 | Sommerstein | 52/235 |
| 5,579,624 | A | * | 12/1996 | Aeberhard | 52/235 X |

FOREIGN PATENT DOCUMENTS

| | | |
|---|---|---|
| DK | 3903511 | 8/1990 |
| EP | 0 297 192 | 1/1989 |
| EP | 0 347 159 | 12/1989 |
| EP | 0 567 087 | 10/1993 |
| FR | 1 294 119 | 10/1962 |

* cited by examiner

*Primary Examiner*—Winnie S. Yip
(74) *Attorney, Agent, or Firm*—Jacobson Holman, PLLC

(57) ABSTRACT

A frontage element including a support and a panel, the panel including at least two fixing parts fixed to the support and a generally plane wall extending between the two fixing parts. At least one of the fixing parts is set back from the plane of the wall and is deformable so that the wall is free to move parallel to itself relative to the support if the temperature of the panel is modified.

12 Claims, 5 Drawing Sheets

FRONTAGE ELEMENT WITH DECORATIVE FACING

This application is filed under 35 USC §371 of international application No. PCT/FR97/01771 filed Oct. 6, 1997.

FIELD OF THE INVENTION

The invention concerns the frontages of buildings and elements for such frontages.

BACKGROUND OF THE INVENTION

Frontage elements including a cellular material core and a plastics material facing panel supported by the core and visible from outside the building are known per se. Such elements are light in weight and produce a lightweight frontage. However, the material of the facing panel generally has a higher coefficient of thermal expansion than the core which makes it difficult to fix the panel to the core in a simple and reliable manner.

BRIEF SUMMARY OF THE INVENTION

One aim of the invention is to propose a frontage element in which the panel is fixed to its support in a simple and reliable manner. This aim is achieved in accordance with the invention by a frontage element including a support and a panel comprising at least two fixing parts fixed to the support and a generally plane wall extending between the two fixing parts, in which at least one of the fixing parts is set back from the plane of the wall and is deformable so that the wall is free to move parallel to itself relative to the support if the temperature of the panel is modified.

The deformation of the or each fixing part therefore enables the wall to expand in its own plane without threatening the quality of the fixing of the panel to the support.

The support advantageously includes a core having at least one lateral face extending in a general direction perpendicular to the wall of the panel, the support including means for fixing the or each fixing part facing and at a distance from the lateral wall of the core.

The fixing means are advantageously connected to a rear face of the core opposite the wall of the panel.

The fixing means are advantageously adapted to receive the fixing part upon movement of the support relative to the panel perpendicularly to the wall.

Accordingly, fixing the panel to the support is a simple matter.

The support advantageously includes a guide surface adapted to guide the fixing part as far as the fixing means from a position near the fixing means upon movement of the support relative to the panel perpendicularly to the wall.

This further simplifies fixing the panel to the support.

The guide surface is advantageously shaped so that the fixing parts move away from each other during movement of the support.

Accordingly, the fixing part is able to deform greatly when the wall expands.

The support advantageously includes first and second assembly parts constituting the fixing means, the first assembly part is advantageously fixed to the core and faces it and the second assembly part is advantageously outside the element and fixed to the first assembly part with a thermally insulative material interposed seal disposed between them. Accordingly, heat transfer from the second assembly part in direct contact with the surrounding air and the first assembly part adjacent the core.

The first assembly part is advantageously a section extending along a lateral face of the core.

Accordingly, the first assembly part constitutes a reinforcing part increasing the mechanical strength of the core.

The core advantageously comprises a cellular material.

A light frontage element is obtained in this way.

The panel advantageously comprises a solid plastics material.

Accordingly, the panel can have widely different appearances depending on the required aesthetic effect of the frontage.

The invention also consists in a system for constructing a frontage comprising two frontage elements in accordance with the invention and a connecting seal adapted to be fixed to the two frontage elements when they are disposed adjacent each other to prevent air passing between the two frontage elements in a direction perpendicular to the walls of the panels.

This limits heat exchange between the outside and the inside of the frontage.

Each frontage element advantageously includes a cover seal such that the cover seals of two adjacent frontage elements come into contact with each other to prevent water spray passing between the two frontage elements in a direction perpendicular to the walls of the panels.

The second assembly part is advantageously adapted to receive a fastener for the cover seal and/or the connecting seal.

This simplifies the assembly of the various parts of each frontage element.

The invention further consists in a frontage comprising frontage elements in accordance with the invention or a system in accordance with the invention.

Other features and advantages of the invention will emerge more clearly from the following description of a preferred embodiment of the invention given by way of non-limiting example.

DETAILED DESCRIPTION OF THE PREFERRED EMBODIMENT

Figure 1:
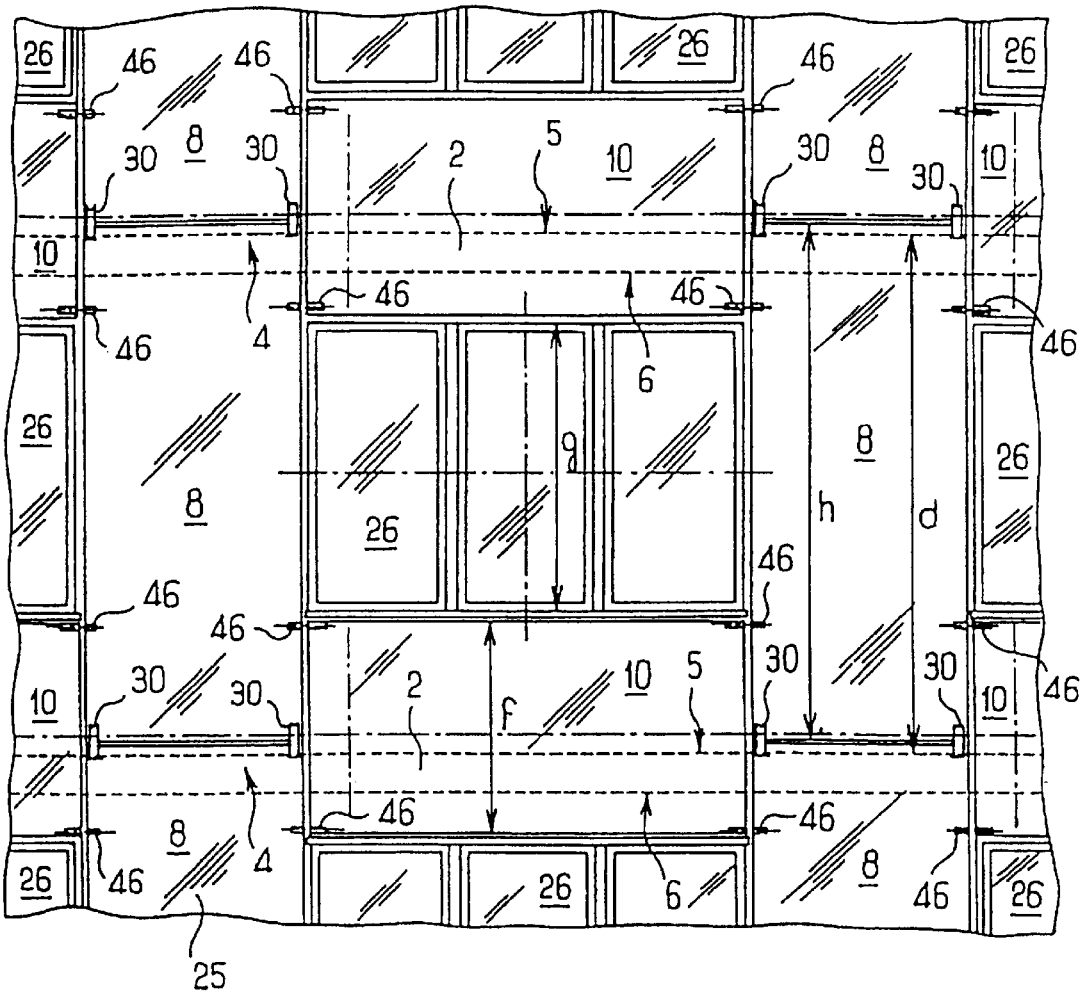
FIG. 1 is a partial front view of the frontage in accordance with the invention, as seen from outside the building.

This embodiment of the frontage in accordance with the invention is fixed to a building comprising a plurality of horizontal floors 2 constructed principally of concrete and extending at different levels, one above the other. Each floor 2 has a vertical rectilinear edge 4 and these edges are parallel to each other in a common vertical plane. The frontage lies against the edges 4. Each floor 2 has plane horizontal top and bottom faces 5 and 6.

The frontage comprises first frontage elements (window piers) 8 and second frontage elements (filler elements) 10. Each element is generally rectangular parallelepiped-shaped with a large front face 12 and a large rear face 14 that are generally plane and parallel to each other.

Each of the first and second frontage elements 8, 10 has a cellular, for example polyurethane foam, core 16. The core 16 has a front face 15 and a rear face 17 that are parallel to each other and covered with respective metal films 0.05 mm thick. The core 16 has two vertical parallel plane rectilinear lateral faces 20. Each lateral face 20 is associated with a rigid galvanized metal reinforcement section 22 which is 2.5 mm thick and covers the lateral face and part of the front and rear faces 15 and 17 of the core. The reinforcement 22 is fixed to the rear face 17 of the core 16 facing towards the floors 2 with the metal film between them, in surface-to-surface contact with the film. It extends the full height 17 of the core.

The filler elements 10 further include two horizontal rigid reinforcement sections 24 associated in the same manner with top and bottom horizontal plane rectilinear faces of the core 16.

The first and second frontage elements 8, 10 each include a plastics materials, for example PVC, facing panel 25 which faces and is parallel to the front face 15 of the core 16 and conceals it from view from outside the building. The facing panel 25 is on the outside of the frontage element so that it can be seen from outside the building. It has a plane face 12 constituting the front face of the frontage element.

The frontage further includes components such as windows 26 or doors which are generally plane and rectangular when seen in elevation.

The first and second frontage elements 8, 10 and the components 26 are disposed side by side in a common plane adjacent the edges 4 of the floors 2.

The first frontage elements 8 are fixed only to the floors 2 by first fixing members or brackets 30. The first frontage element 8 are disposed in a plurality of spaced parallel vertical rows. The first frontage elements 8 in each row are adjacent each other and have their vertical lateral faces aligned. Each first frontage element 8 has a longitudinal dimension or height h in the vertical direction perpendicular to the floors 2. The dimension h is equal to the distance d between the like faces (for example the top faces 5) of two floors 2 that are adjacent each other in the vertical direction. The distance d is the height of a story of the building.

Each first frontage element 8 is fixed to two adjacent floors 2 at different levels. It is fixed to each floor by two brackets 30 that also fix the next frontage element 8 in the row to the same floor 2.

Each bracket 30 has first and second plates 32, 34 fixed to each other at a right angle. The first plate 32 has four orifices 44 through it for fixing each of two first frontage elements 8 to the bracket by means of two screws or rivets passing through two of the orifices 44. The first plate 32 is vertical and parallel to the rear face 17 of the core and is fixed to each of the two first frontage elements 8 by means of two screws or rivets with axes 90, for example. One of the rods passes completely through the thickness of the core 16 and is connected to one of the vertical rigid reinforcements 22 on either side of the core and the other rod passes through the reinforcement 22 and the core 16. The second plate 34 is horizontal and is embedded in the floor 2. The second plate 34 has three screw-threaded circular housings 38 passing through the thickness of the plate and disposed in a triangle. The bracket includes three grubscrews 40 engaged in the respective housings 38 to project from a face of the second plate 34 opposite the first plate 32.

Figure 3:
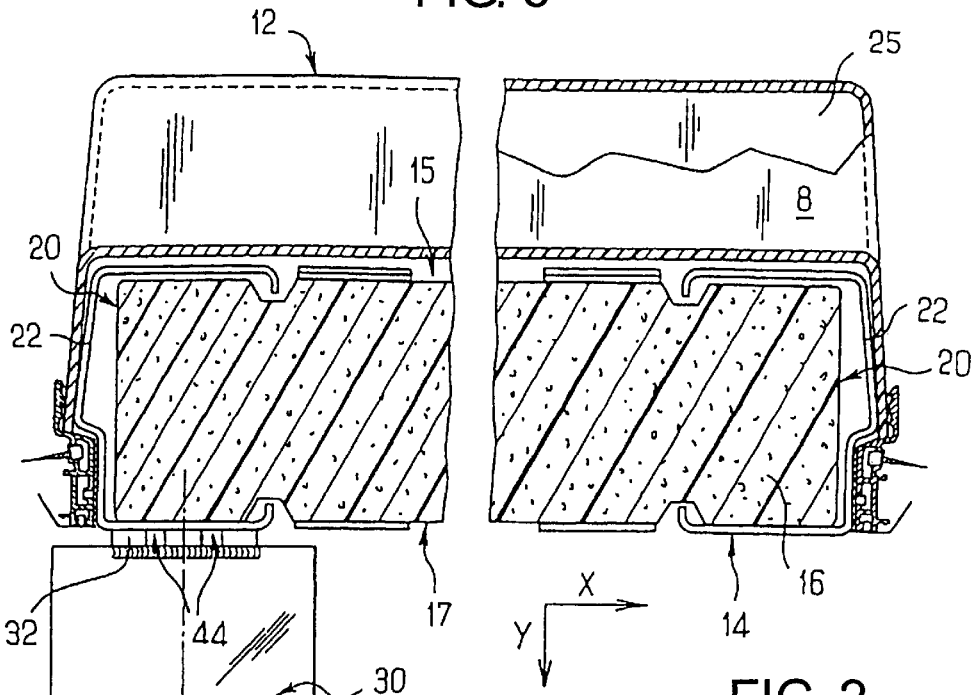
FIG. 3 is a top view of the first fixing member from FIG. 2 and a first frontage element in horizontal section.
Figure 2:
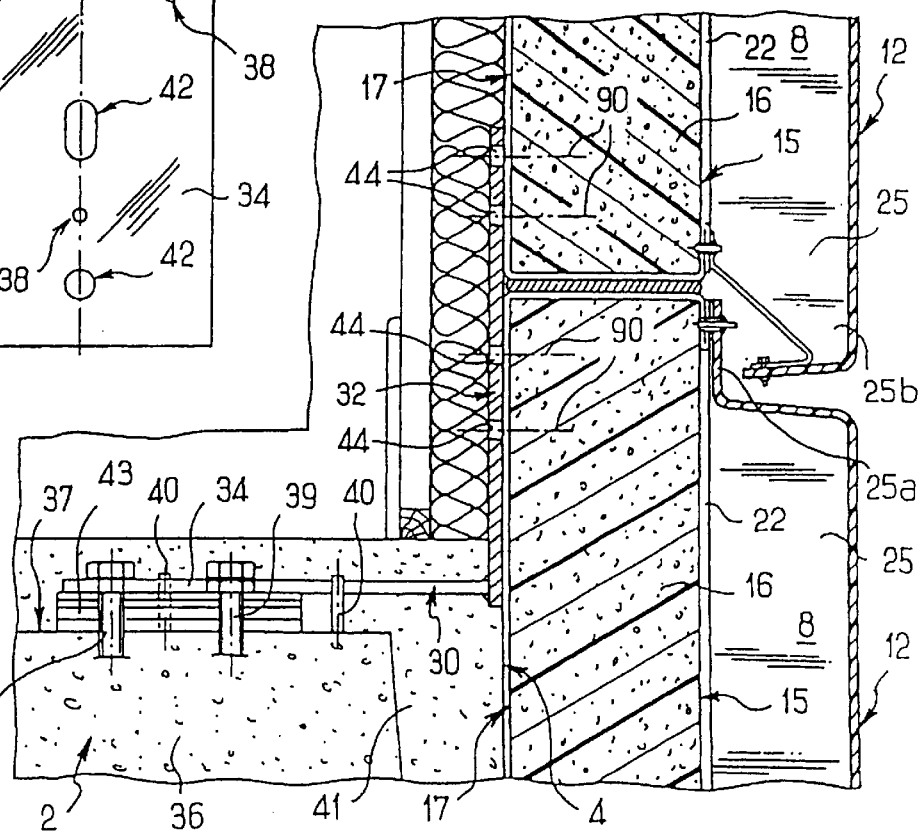
FIG. 2 is a view of the frontage in cross-section at the level of a first fixing member.
Figure 4:
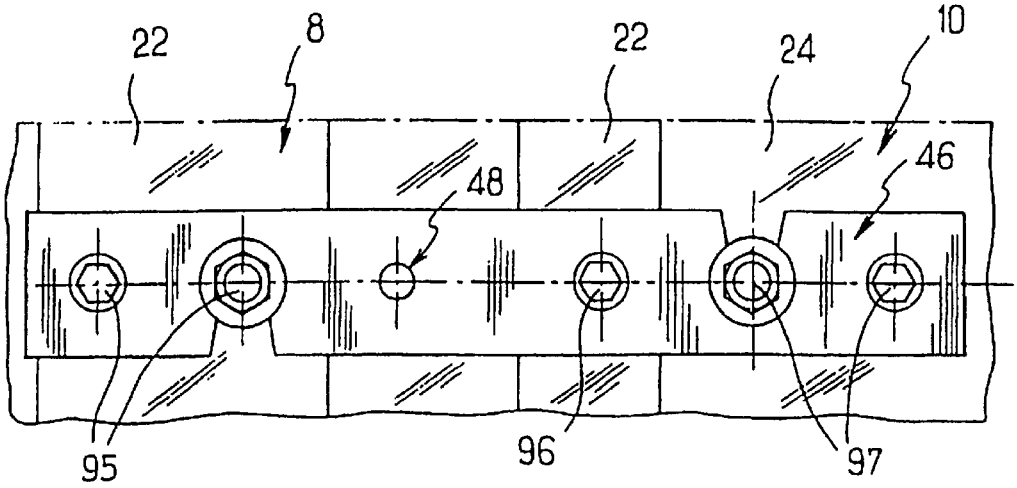
FIG. 4 is a front view of a second fixing member connected to first and second frontage elements.
Figure 5:
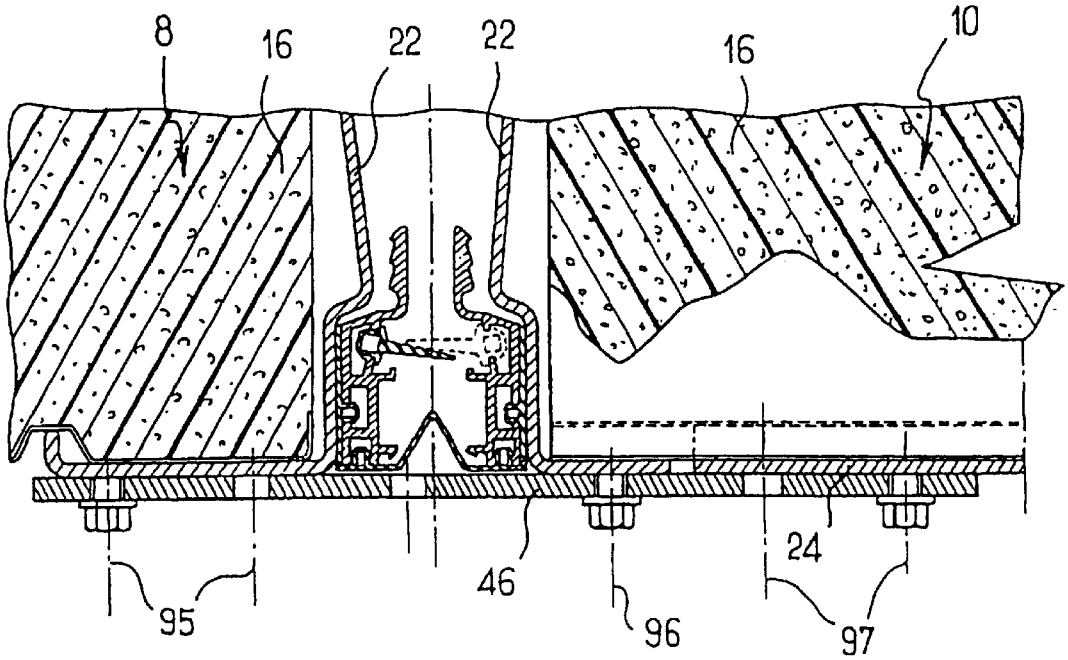
FIG. 5 is a top view of the second fixing member from FIG. 4 and first and second frontage elements in horizontal section.

The bracket 30 is installed in the following manner. A horizontal concrete slab 36 is constructed to form the fabric of the floor 2. A rebate in the slab adjacent the edge 4 of the floor has a generally horizontal plane face 37. The bracket is placed with the first plate 32 directed vertically upwards near the edge 4 of the floor and with the ends of the three grubscrews 40 in contact with the plane face 37 of the rebate. The grubscrews 40 are then turned to adjust the angular position of the bracket 30 relative to the face 37 of the rebate in two mutually perpendicular horizontal directions, for example directions X and Y in FIG. 3. The second plate 34 has two orifices 42, an elongate orifice near the first plate 32 and a circular orifice far away from the first plate. Two attachment screws 39 are engaged in the respective orifices 42. When the bracket is in the required angular position, the fixing screws 39 are screwed into the slab 36 to fix the bracket rigidly to the slab. A filler material such as mortar 41 is then poured into the rebate to fill the rebate completely and cover the horizontal second plate 34 without covering the vertical first plate 32. When it has hardened this material immobilizes the bracket. After tightening the fastening screws 39, one or more shims 43 can be placed between the horizontal second plate 34 and the top face 37 of the rebate. The dimensions of the brackets 30 are very much less than the dimensions of the first and second frontage elements 8, 10 in the horizontal and vertical directions, and in particular less than the greatest dimension of these elements.

The two frontage elements 10 and the components 26 have the same horizontal dimension or length and are disposed in a plurality of spaced vertical rows alternating with the rows of first frontage elements 8. The second frontage elements 10 and the components 26 alternate in each row and their vertical lateral faces are aligned with each other. The second frontage elements 10 have a vertical dimension or height f and the components 26 have a vertical dimension or height q. The sum of the height f and the height q is equal to the height h of the first frontage elements 8.

Each second frontage element 10 is opposite two first frontage elements 8 of each adjacent row. Each second frontage element 10 is fixed only to these four first frontage elements 8. Each component 26 is fixed only to a first frontage element 8 of each adjacent row.

The second frontage elements 10 are fixed by second fixing members such as horizontal elongate plane metal lugs 46 fixed to the vertical reinforcements 22 of the first frontage elements 8. The lug 46 has six orifices 48 through it. Two of the orifices 48 receive fastenings such as screws or rivets with axes 95 passing through a vertical reinforcement 22 and the core 16 of the associated first frontage element 8. A third orifice 48 receives a fastener with axis 96 passing through a vertical reinforcement 22 and the core 16 of the second frontage element 10. Two other orifices 48 receive two fasteners with axes 97 passing through one of the horizontal reinforcements 24 of the second frontage element 10.

The panels 25 of the first frontage elements 8 have a profile in vertical cross-section such that the panel has a top area 25*a* near the core 16 and a bottom area 25*b* far away from the core and covering the outside of the top area 25*a* of the adjacent first frontage element 8 in the row. This produces an overlapping tile-like arrangement which conceals the junctions between the horizontal faces of the first frontage elements 8.

The frontage is therefore constructed by means of a system comprising first elements 8 having a cellular core 16 and adapted to be fixed to a building, second elements 10 and means 30 for fixing the second elements 10 to the first elements 8 with the first and second elements 8, 10 in the same plane.

Construction involves fixing the first elements 8 to the building, disposing the first elements 8 and the second elements 10 in a common vertical plane, and fixing the second elements 10 to the first elements 8.

The frontage obtained in this way is light in weight.

Figure 8:
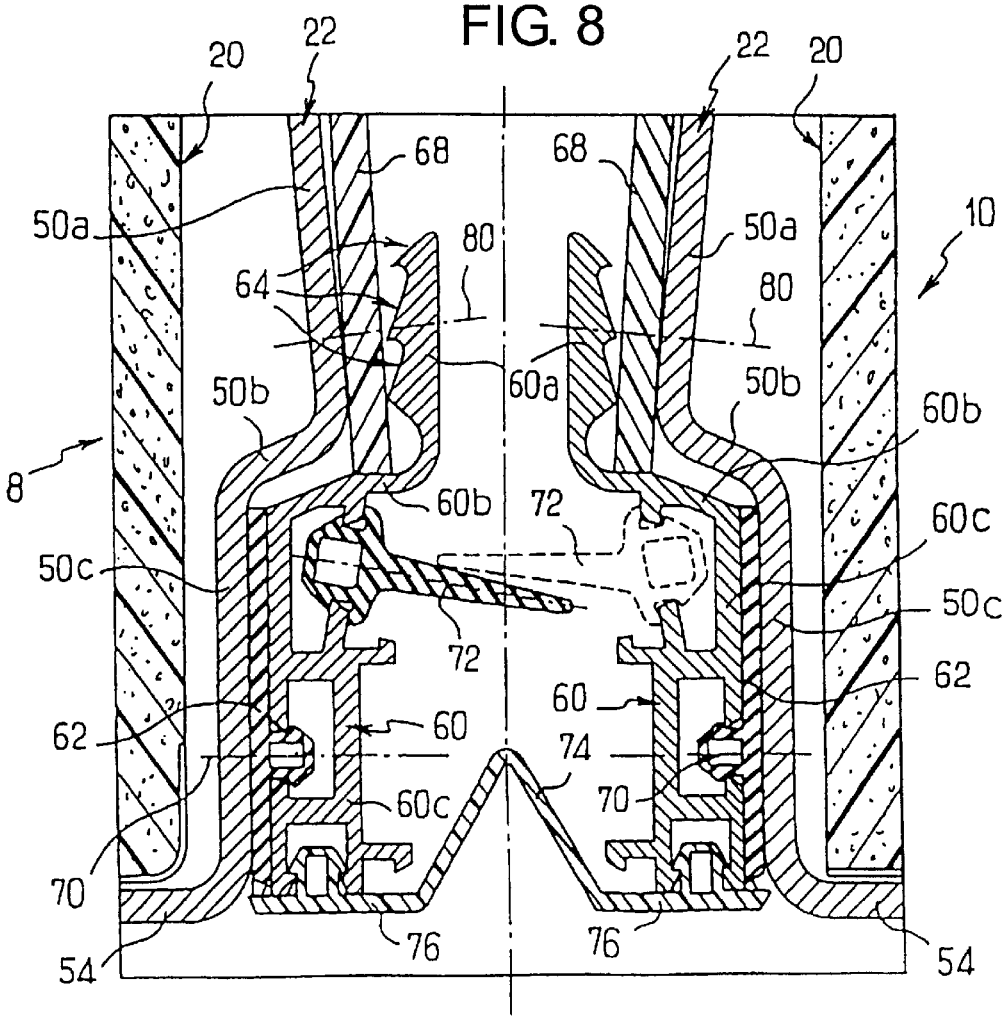
FIG. 8 shows a detail of the junction to a larger scale.

The first and second frontage elements 8, 10 will now be described in more details with reference to FIGS. 6 to 8.

Figure 6:
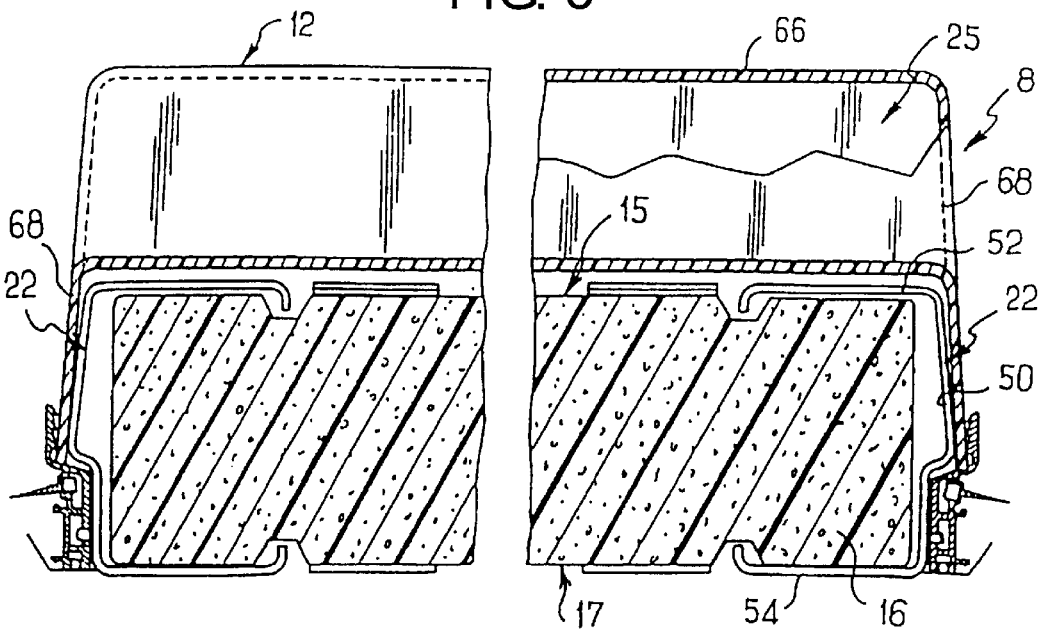
FIG. 6 is a cut away partial view of a first frontage element in horizontal cross-section in a plane perpendicular to its large plane faces and to its lateral faces which are vertical in use.
Figure 7:
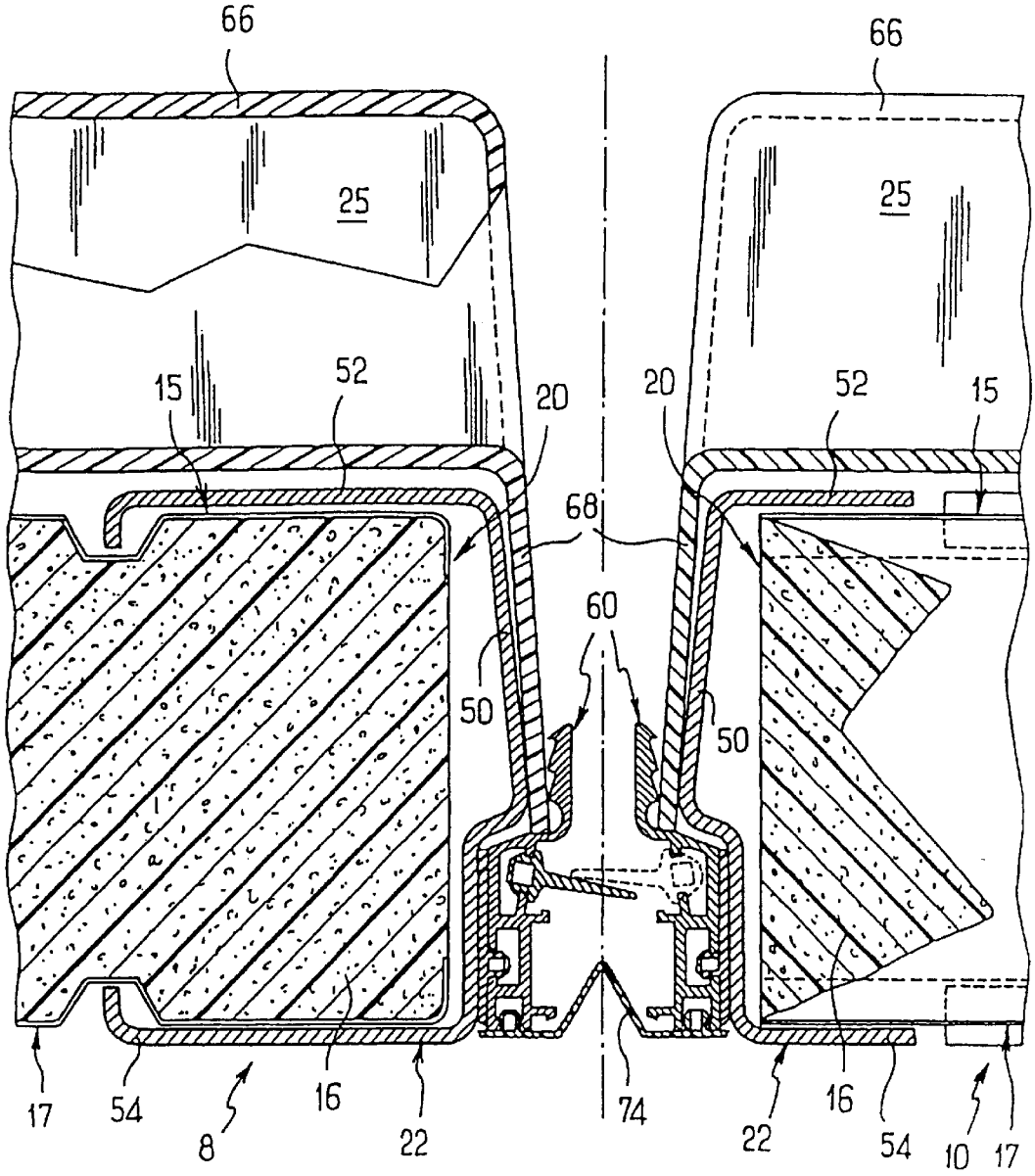
FIG. 7 is a sectional view analogous to FIG. 6 showing the junction between adjacent first and second frontage elements.

FIG. 6 shows a first frontage element 8. Each of the first and second frontage elements includes a generally rectangular parallelepiped-shaped core 16 having large plane parallel front and rear faces 15, 17, two parallel plane lateral faces 20 which are perpendicular to the large faces 15 and 17 and vertical in use, and two parallel plane end faces which are perpendicular to the large faces 15 and 17 and horizontal in use. Each face 15, 17 is covered with a metal film.

The frontage element includes two metal reinforcing sections or first assembly parts 22. Each reinforcement 22 has a generally U-shaped profile in cross-section with a base 50, a front branch 52 and a rear branch 54, the two branches being parallel to each other. The front and rear branches are separated from each by a distance that is slightly greater than the thickness of the core 16, i.e. the distance between the large front face 15 and the large rear face 17 of the core. The reinforcement 22 has a length similar to that of the vertical lateral faces 20 of the core. Each reinforcement 22 is disposed to receive one lateral face 20 of the core, the front branch 52 facing the front face 15, the rear branch 54 facing the rear face 17 and the base 50 facing the lateral face 20. The rear branch 54 is in surface-to-surface contact with to the rear face 17 of the core and fixed to it through the metal film by two longitudinal ends of the reinforcement 22. The front branch 52 is parallel to, spaced from and faces the front face 15 and the base 50 is at a distance from and faces the lateral face 20.

The base 50 has an S-shaped profile from one of the two branches 52, 54 to the other. From the front branch 52 to the rear branch 54 the base 50 has a plane first portion 50*a* which is inclined and extends away from the lateral face 20, followed by a median second portion 50*b* that converges with the lateral face 20 and a plane third portion 50*c* parallel to the lateral face 20.

The frontage element includes two second assembly parts 60 associated with respective first assembly parts 22. Each second assembly part 60 is an aluminum section and has a length equal to that of the first assembly part 22. The second assembly part 60 has an S-shaped profile in cross-section similar to that of the branch 50 of the first assembly part 22, with a first portion 60*a*, a second portion 60*b* and a third portion 60*c*.

The third portion 50*c* of the first assembly part and an area of the third portion 60*c* of the second assembly part are substantially the same shape with substantially the same dimensions. They are fixed to each other, for example by screws or rivets with axes 70 regularly spaced along the sections and passing through them. Throughout their length an interposed synthetic rubber seal 62 forms a thermal break between the two assembly parts 22 and 60.

The median second portions 50*b* and 60*b* face each other. The two first portions 50*a* and 60*a* face each other and are parallel to each other. The median portion 60*a* of the second assembly part 60 is shorter than the median portion 50*a* of the first assembly part 22 and there are toothed-shaped raised portions 64 on one face of the median portion 60*a* facing towards the median portion 50*a*.

The core 16 and the four assembly parts 22, 60 of the element constitute a support for the element.

The frontage element includes a panel 25 comprising a rectangular plane wall 66 having dimensions similar to those of the large faces 15, 17 of the core 16. A front face 12 of that wall is intended to be visible from outside the frontage. The panel has four plane edges 68 extending from the sides of the rectangular wall 66 and opposite each other in pairs on respective opposite sides thereof. The edges 68 are generally perpendicular to the wall 66 and set back from its plane on the side opposite the visible face 12. Each edge 68 is slightly inclined in the direction away from the facing edge 68.

The two edges 6, which are vertical in use, spaced from each other and at two ends of the panel, constitute two parts for fixing the panel 25 to the support.

The two assembly parts 22, 60 adjacent each edge 68 constitute means for fixing that edge to the support. The edge 68 is designed to be inserted between the two first portions 50*a* and 60*a* so that it is clamped between them and retained by the raised portions 64. The first portion 50*a* of the first assembly part 22 is more steeply inclined to the lateral face 20 of the core than the associated edge 68. It constitutes a guide surface adapted to guide the edge 68 as far as the fixing means from a position near the fixing means, the panel 25 being fixed to the support by moving the support relative to the panel 25 in a direction perpendicular to the wall 66 of the panel. When the panel 25 has been fixed to the support the wall 66 is parallel to and spaced from the front face 15 of the core, which it covers. During this movement the two edges 68 move apart. In this position the first assembly part 22 is inside the frontage element and the second assembly part 60 is outside the frontage element.

The fixing of the edges 68 to the fixing means can be strengthened by fixing each edge 68 and the first portions 50*a*, 60*a*, for example by means of screws or rivets with axes 80 passing completely through them and regularly spaced along the sections.

Each frontage element includes a synthetic rubber cover seal section 72 fixed to the second assembly part 60 near the median portion 60*b* and has a generally plane lip parallel to the wall 66 and extending towards the outside of the frontage member.

The system further comprises a connecting seal section 74 having a V-shaped profile with each branch of the V-shape extending by a lateral lug 76 with a particular profile. When two frontage elements are disposed in the same plane and adjacent each other with their second assembly parts 60 facing each other and parallel to each other, the connecting seal 74 is adapted to be fixed to the two second assembly parts 60 by its two lateral lugs 76, in the vicinity of their rear branches 54. The apex of the V-shape then points in the direction towards the cover seals 72.

In this position, the two cover seals 72 come into contact with each other and are pressed together to prevent water spray passing between the two frontage elements, from the front towards the rear, in a direction perpendicular to the walls 66 of the panels. The connecting seals 74 covers the gap between the two frontage elements and provides an air seal in the same direction. The interposed seals 62, cover seals 72 and connecting seals 74 extend the full length of the assembly parts 22 and 60. The second assembly part 60 is adapted to receive the interposed seal 62, the cover seal 72 and the associated connecting seal 74 before it is fixed to the first assembly part 22.

In this position, the two frontage elements are spaced from each other. The edges 68 are deformable so that the wall 66 is free to move parallel to itself relative to the associated support if the temperature of the panel 25 changes, in particular if the panel expands. The fixing of the panel to the support is not degraded by this deformation.

The first assembly part 22 is made of steel, for example, and is inside the frontage element and in contact with the brackets 30. The second assembly part 60 is outside the frontage element and is in direct contact with the outside air. It is made of aluminum, for example. The seal 74 limits heat transfer from the second assembly part 60 to the first assembly part 22.

The wall 66 of the panel 25 can have varied shapes, raised patterns and colors to suit the requirements of the frontage designer. The panel 25 is advantageously a thermoformed component.

What is claimed is:

1. A frontage element including a support and a panel, said panel comprising at least two fixing parts fixed to the support and a generally plane wall extending between the two fixing parts, at least one of the fixing parts being set back from the plane of the wall and being deformable so that the wall is free to move parallel to itself relative to the support if the temperature of the panel is modified, the support including a core having at least one lateral face extending in a general direction perpendicular to the wall of the panel, the support including fixing means for fixing the at least one of the at least two fixing parts facing and at a distance from the lateral wall of the core, the support including first and second assembly parts constituting the fixing means, the first assembly part being fixed to the core and facing the core, and the second assembly part being fixed to the first assembly part with a thermally insulative material interposed seal disposed between the first assembly part and the second assembly part.

2. A frontage element according to claim 1, wherein the fixing means are connected to a rear face of the core opposite the wall of the panel.

3. A frontage element according to claim 1, wherein the fixing means receives the at least one of the fixing parts upon movement of the support relative to the panel perpendicularly to the wall.

4. A frontage element according to claim 3, wherein the support includes a guide surface for guiding the fixing part as far as the fixing means from a position near the fixing means upon movement of the support relative to the panel perpendicularly to the wall.

5. A frontage element according to claim 4, wherein the guide surface is shaped so that the fixing parts move away from each other during movement of the support.

6. A frontage element according to claim 1, wherein the first assembly part is a section extending along the lateral face of the core.

7. A frontage element according to claim 1, wherein the core comprises a cellular material.

8. A frontage element according to claim 1, wherein the panel comprises a solid plastics material.

9. A system for constructing a frontage, including two frontage elements according to claim 1 and a connecting seal to be fixed to the two frontage elements when they are disposed adjacent each other to prevent air passing between the two frontage elements in a direction perpendicular to the walls of the panels.

10. A system for constructing a frontage, including the frontage according to claim 9, wherein each frontage element includes a cover seal such that the cover seals of two adjacent frontage elements come into contact with each other to prevent water spray passing between the two frontage elements in a direction perpendicular to the walls of the panels.

11. A system for constructing a frontage, including the frontage according to claim 10, wherein a second assembly part receives a fastener for at least one of the cover seal and the connecting seal.

12. A frontage element including a support and a panel, said panel comprising at least two fixing parts fixed to the support and a generally plane wall extending between the two fixing parts, at least one of the fixing parts being set back from the plane of the wall and being deformable so that the wall is free to move parallel to itself relative to the support if the temperature of the panel is modified, the support including a core having at least one lateral face extending in a general direction perpendicular to the wall of the panel, the support including fixing means for fixing the at least one of the at least two fixing parts facing and at a distance from the lateral wall of the core, the fixing means being connected to a rear face of the core opposite the wall of the panel.

* * * * *